US006073686A

United States Patent [19]

Park et al.

[11] Patent Number: 6,073,686

[45] Date of Patent: Jun. 13, 2000

[54] HIGH EFFICIENCY MODULAR OLF HEAT EXCHANGER WITH HEAT TRANSFER ENHANCEMENT

[75] Inventors: Byung-Kyu Park; Hyo-Bong Kim; Koon-Sup Oh, all of Daejeon-Si; Joon-Sik Lee, Seoul, all of Rep. of Korea

[73] Assignee: Korea Institute of Machinery & Materials, Daejon-Si, Rep. of Korea

[21] Appl. No.: 09/236,229

[22] Filed: Jan. 22, 1999

[30] Foreign Application Priority Data

Nov. 20, 1998 [KR] Rep. of Korea ..... 98-49932

[51] Int. Cl.[7] ..... F28F 9/26

[52] U.S. Cl. ..... 165/144; 165/110; 165/152; 165/153; 165/174; 165/149

[58] Field of Search ..... 165/110, 144, 165/149, 152, 153, 174

[56] References Cited

U.S. PATENT DOCUMENTS 4,309,987 1/1982 Higgins, Jr. ..... 165/174 X
5,052,477 10/1991 Nakajima et al. ..... 165/153
5,669,438 9/1997 Beales et al. ..... 165/152

FOREIGN PATENT DOCUMENTS 582870 10/1958 Italy ..... 165/174

*Primary Examiner*—Allen Flanigan
*Attorney, Agent, or Firm*—Arent Fox Kintner; Plotkin & Kahn, PLLC

[57] ABSTRACT

A high efficiency modular OLF heat exchanger with heat transfer enhancement is disclosed. The OLF heat exchanger has an oblique louver fin provided with oblique strips. The oblique louver fin thus effectively forms transverse and longitudinal vortexes in a main gas flow while breaking the boundary layer of the gas flow, thus having an improved heat transferring effect. In the OLF heat exchanger, a plurality of flat tubes are assembled with two opposite header pipes, thus forming a module. The OLF heat exchanger is thus manufactured while easily permitting changes in its size and heat exchanging capacity by assembling a selected number of modules into a single body using a plurality of header pipe sockets. The oblique strips violently mix the gas flow and thereby further improve the heat transferring effect of the louver fin. The oblique louver fin thus has advantages expected from typical louver fins with swirlers and typical offset strip fins with swirlers.

12 Claims, 7 Drawing Sheets

HIGH EFFICIENCY MODULAR OLF HEAT EXCHANGER WITH HEAT TRANSFER ENHANCEMENT

BACKGROUND OF THE INVENTION

1. Field of the Invention

The present invention relates, in general, to high efficiency modular OLF (oblique louver fin) heat exchangers preferably used as condenser, evaporator and radiators of automobiles or military tanks or the like and, more particularly, to a high efficiency modular OLF heat exchanger having newly designed louver fins provided with oblique strips, the oblique strips being capable of forming transverse and longitudinal vortexes in a main gas flow around each louver fin while breaking the boundary layer of the gas flow, thus enhancing the heat transferring effect of said fins.

2. Description of the Prior Art

As well known to those skilled in the art, the thermal resistance, caused by external gas or atmospheric air, in conventional plate-fin heat exchangers is higher than 80% of the total thermal resistance of such a heat exchanger, so that the heat exchanging effect of such heat exchangers is almost completely determined by the operational function or heat transferring effect of fins set in said heat exchangers.

The fins of such heat exchangers typically have a small hydraulic diameter and a low gas density within a flow region of low Reynolds number, so that it is possible to somewhat improve the heat transferring effect of the fins by changing the geometrical configuration of said fins within the small Reynolds number flow region. Such a change in the geometrical configuration of said fins preferably reduces the thermal resistance of the fins, resulting in an improvement in the heat transferring effect of the fins.

In the prior art, louver fins and offset strip fins (OSF) have been typically used as fins for such heat exchangers.

It is noted that the louver fins have a high thermal efficiency. However, the typical louver fins are problematic in that the thermal efficiency of the fins is undesirably reduced at positions around the rear strips of each fin. That is, since a gas flow is formed along the louver angle at positions around the front strips of each fin, the path length of the gas flow around the front strips is lengthened. This allows the heat transferring effect of the fins at positions around the front strips to be improved. However, since the path length of the gas flow at positions around the rear strips of each fin is shortened, the heat transferring effect of the fin at positions around the rear strips is regrettably reduced. In addition, the strips of the typical louver fin are designed to have an angle of attack of 90° with respect to the gas flow. Therefore, the strips do not form any swirl in the gas flow, so that the strips fail to give good heat transfer enhancing effect, caused by a longitudinal vortex, to the louver fin.

On the other hand, the typical offset strip fins (OSF) are designed to be offset with each other, thus preferably breaking the boundary layer of the gas flow due to a primary offset effect. However, the typical offset strip fins are problematic in that they fail to form any swirl in a gas flow, thus merely providing a one-dimensional or unidirectional offset effect along the main gas flow on the path line. Therefore, the heat transferring effect of the offset strip fins is regrettably lower than that of the above-mentioned louver fins.

Another problem, experienced in the heat exchangers having the above-mentioned louver or offset strip fins, is that the fin assembly is not formed as a module, so that it is almost impossible to manufacture heat exchangers while changing the size and capacity of the heat exchangers when necessary.

SUMMARY OF THE INVENTION

Accordingly, the present invention has been made keeping in mind the above problems occurring in the prior art, and an object of the present invention is to provide a high efficiency modular OLF heat exchanger, which has an oblique louver fin attached to the base wall of a multi-channeled flat tube and provided with oblique strips, thus effectively forming transverse and longitudinal vortexes in a main gas flow around each louver fin while breaking the boundary layer of said gas flow and enhancing the heat transferring effect of the louver fin.

Another object of the present invention is to provide a high efficiency modular OLF heat exchanger, of which a plurality of multi-channeled flat tubes are assembled with two opposite header pipes, thus forming a module, so that the OLF heat exchanger is manufactured while easily changing its size and heat exchanging capacity by assembling a selected number of modules into a single body using a plurality of header pipe sockets.

In the heat exchanger of this invention, the strips of each louver fin are designed to be oblique with an angle of attack "β" ($0° \leqq \beta \leqq 80°$). Such oblique strips preferably form transverse and longitudinal vortexes in the gas flow around the louver fin, thus more violently mixing the gas flow and further improving the heat transferring effect of the louver fin. The oblique strips also force the gas flow to collide with the flat tubes, thus improving the heat transferring effect of the flat tubes. Each oblique louver fin is closely corrugated from the first to the last end with a short pitch. Therefore, the louver fins preferably form a swirl motion in the gas flow around the fins, thus providing a three-dimensional cutoff effect on the path line of the gas flow. Such an oblique louver fin also lengthens the path length of the gas flow around the fin. In addition, the flow length of the gas flow around the louver fin may be controlled by changing the angle of attack "β" of the oblique strips of said louver fin, so that the louver fin more effectively and periodically breaks the boundary layer of the gas flow. That is, the oblique strips primarily reduce the thickness of the boundary layer and finally remove said boundary layer within the vortex area defined between next strips, thus improving the heat transferring effect of the louver fin. In a brief description, the oblique louver fins are designed to selectively have the advantages expected from typical louver fins and typical offset strip fins, and to have better flow mixing by the 3 dimentional swirl motion due to the angle of attack.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
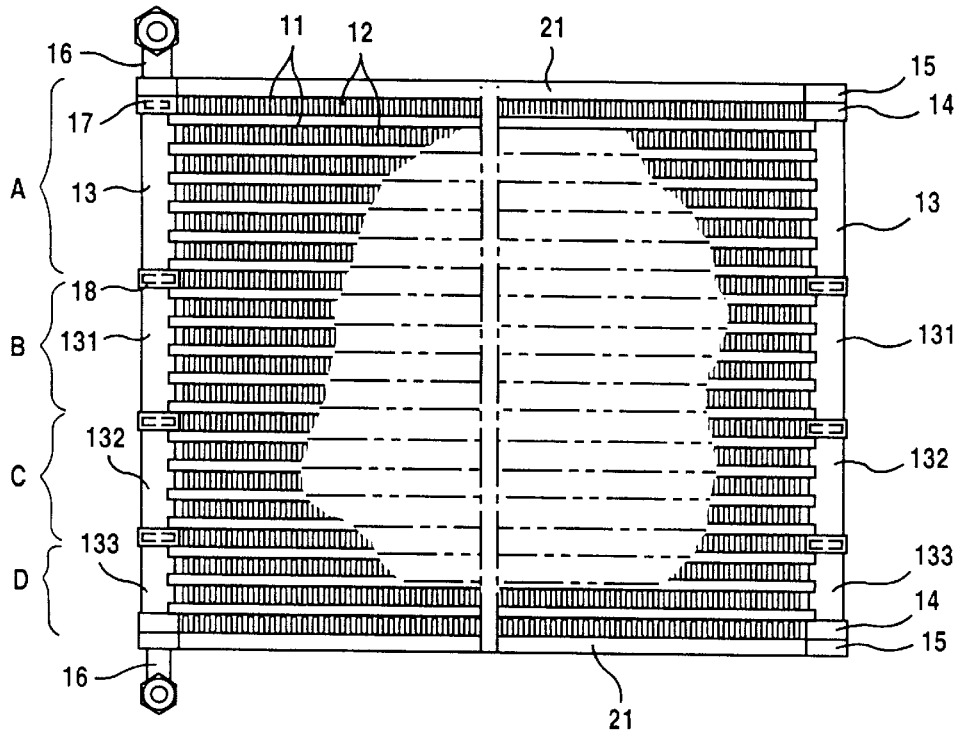
FIG. 1 is a view showing the construction of a high efficiency modular OLF heat exchanger in accordance with the preferred embodiment of the present invention.
Figure 2:
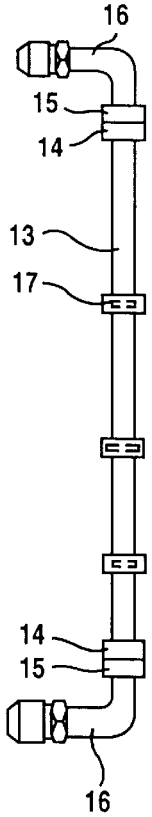
FIG. 2 is a view of a side pipe set in the heat exchanger of this invention.
Figure 3:
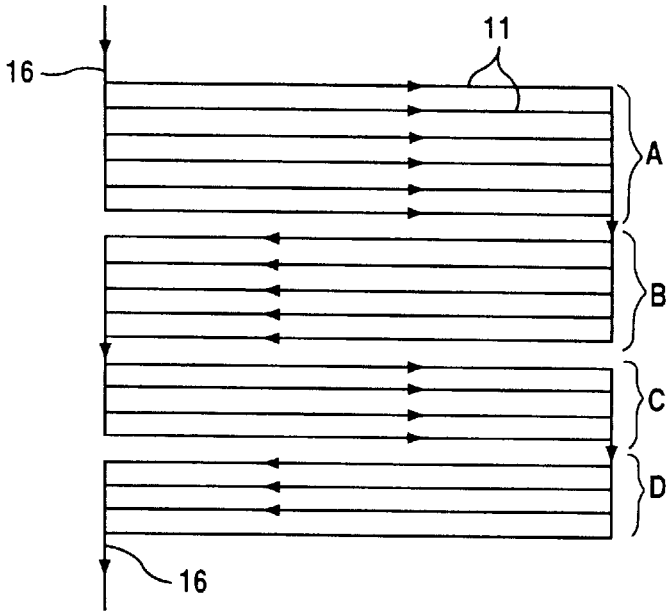
FIG. 3 is a view showing the flow path of the heat exchanger of this invention, with four modules being assembled into a single body by a plurality of header pipe sockets.

FIG. 1 shows the construction of a high efficiency modular OLF (oblique louver fin) heat exchanger of this invention. FIG. 2 shows a side pipe set in the heat exchanger of this invention. FIG. 3 shows the flow path of the heat exchanger of this invention, with four modules being assembled into a single body by a plurality of header pipe sockets.

As shown in the drawings, the OLF heat exchanger of this invention comprises two length adjustable side pipes. Of the two side pipes, vertically positioned at both sides of the heat exchanger, either one has inlet and outlet tubes 16 at both ends thereof. The two side pipes individually consist of a plurality of header pipes 13, 131, 132 and 133. The above header pipes have predetermined different lengths and are selectively assembled with each other into a side pipe, thus accomplishing a desired size and capacity of the heat exchanger. Each of the header pipes has a plurality of fitting slits 19 regularly arranged in an axial direction. A plurality of header pipe sockets 14, individually having an open ring 17 or a blocking disk 18, are used for linearly coupling the header pipes into a side pipe. In such a case, the sockets 14 having rings 17 and the sockets 14 having disks 18 are alternately arranged on the side pipe. The sockets 14 thus alternately open and close the side pipe so as to change the fluid flow path of the heat exchanger.

The heat exchanger also comprises a plurality of flat tubes 11. The flat tubes 11 are fitted into the fitting slits 19 of two opposite header pipes 13, 131, 132, 133 at both ends thereof, thus extending horizontally between the two header pipes while being regularly spaced out. Each of the flat tubes 11 is obliquely cut at a cutting angle "θ" at both ends thereof and has an oblique louver fin 12 on its top wall. The louver fin 12 is repeatedly and obliquely cut at an angle of attack "β" on its surface, thus having a plurality of oblique strips. The strips allow a main gas flow to collide thereon when the gas flow passes by the louver fin 12.

Top and bottom support frames 21 horizontally extend at the top and bottom ends of the heat exchanger while being held by the two side pipes using a plurality of end caps 15, thus supporting the flat tubes 11 while blocking both ends of a side pipe free from any inlet or outlet tube 16. Each of the support frames 21 is longitudinally channeled, thus having a U-shaped cross-section.

In the above OLF heat exchanger, a plurality of flat tubes 11 are assembled with two opposite header pipes 13, 131, 132, 133, thereby forming a module having a predetermined heat exchanging capacity. The heat exchanger of this invention is, therefore, somewhat easily formed by assembling a selected number of modules into a single body using a plurality of sockets 14 and the two support frames 21 in accordance with a desired size and heat exchanging capacity.

As shown in FIGS. 1 and 3, due to the rings 17 and the disks 18 alternately set in the header pipe sockets 14 of each side pipe, the fluid path of the heat exchanger of this invention is repeatedly changed at the joints between the modules. In the drawings, the modules, individually having a plurality of flat tubes 11 held by two header pipes 13, 131, 132, 133 at both ends thereof, are designated by the characters A, B, C and D, respectively.

Figure 4:
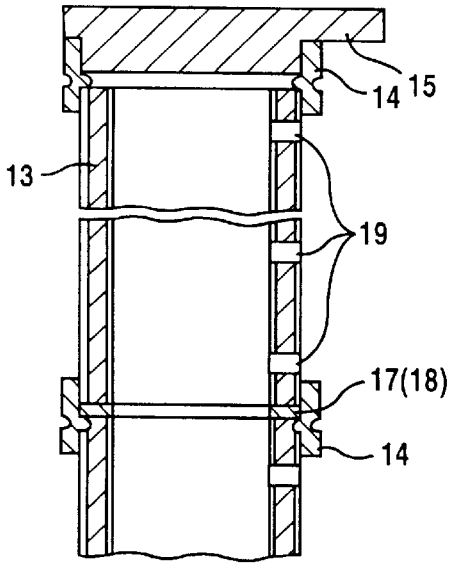
FIG. 4 is a sectional view showing a joint between an end cap and a header pipe, the joint being accomplished by a header pipe socket.
Figure 5:
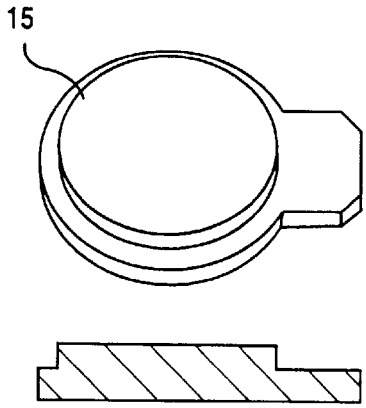
FIG. 5 shows the end cap of this invention in a perspective view and a sectional view.
Figure 6:
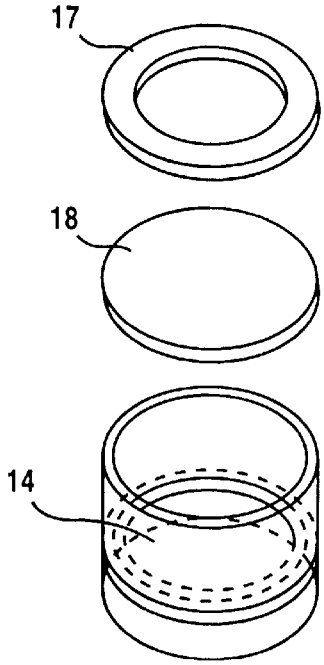
FIG. 6 is an exploded perspective view of a header pipe socket used for jointing header pipes into a side pipe, the socket being selectively provided with an open ring or a blocking disk.

FIG. 4 shows a joint between one end cap 15 and one header pipe 13, with a header pipe socket 14 accomplishing the joint. FIG. 5 shows the above end cap 15 in a perspective view and a sectional view. FIG. 6 shows a header pipe socket 14 used for jointing the header pipes into a side pipe, the socket 14 being selectively provided with an open ring 17 or a blocking disk 18.

As shown in the drawings, the socket 14 is a cylindrical member having an interior ring suitable for seating a ring 17 or a disk 18 in the socket 14.

In addition, the end cap 15 is assembled with a socket 14 provided at each end of the side pipes, thus supporting the flat tubes 11 while blocking both ends of a side pipe free from any inlet or outlet tube 16.

Figure 7:
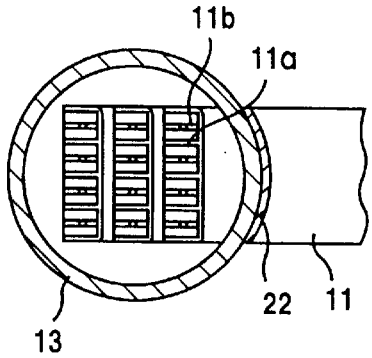
FIG. 7 is a plan view showing an end of a multi-channeled flat tube fitted into a fitting slit of a header pipe of this invention.
Figure 7A:
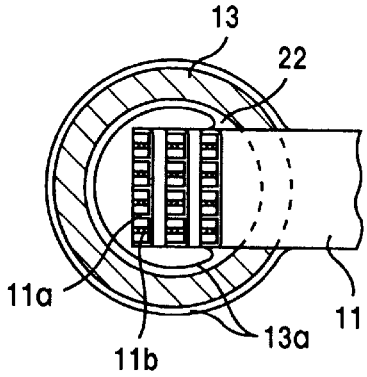
FIG. 7*a* is a plan view corresponding to FIG. 7, but showing both the multi-channeled flat tube welded to the header pipe at the junction between them and the header pipe coated with the same material as a welding material of the heat exchanger of this invention.

As shown in FIG. 7, the end of the multi-channeled flat tube 11 is fitted into a fitting slit 19 of the header pipe 13 of this invention. As shown in FIGS. 7 and 7*a,* the multi-channeled flat tube 11 is welded to the header pipe 13 at the junction 22 between them, while the header pipe 13 is coated with the same material 13*a* as a welding material of the heat exchanger of this invention.

Figure 8:
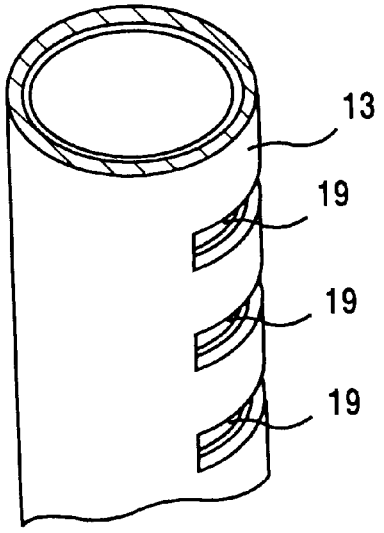
FIG. 8 is a perspective view of a header pipe provided with a plurality of fitting slits for holding a plurality of flat tubes included in a module of this invention.
Figure 9:
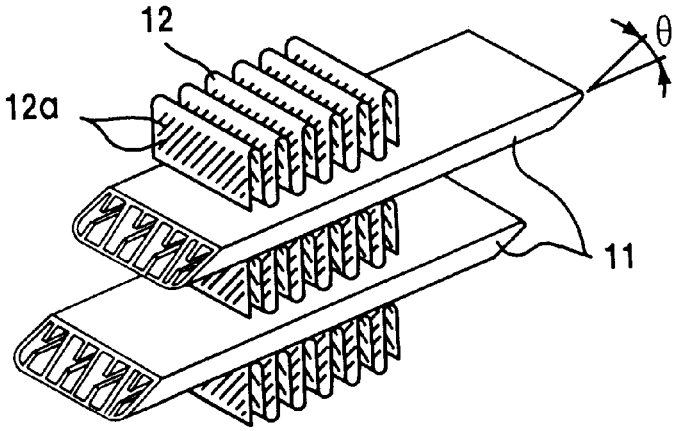
FIG. 9 is a perspective view showing two multi-channeled flat tubes of this invention, the flat tubes being individually and obliquely cut at a cutting angle "θ" at both ends thereof and having one oblique louver fin on the top wall thereof.

As shown in FIG. 8, the header pipe 13, having a cylindrical, semicylindrical, retangular or similar cross-section, is partially cut at regularly spaced positions along its axis, thus having a plurality of fitting slits 19 used for holding the flat tubes 11. FIG. 9 shows two multi-channeled flat tubes 11 of this invention. As shown in FIG. 9, the flat tubes 11 are individually and obliquely cut at a cutting angle "θ" at both ends thereof. Each of the flat tubes 11 is fitted into associated fitting slits 19 of two opposite header pipes 13 at both oblique ends thereof, thus being held by the two pipes 13. The flat tubes 11 also individually have an oblique louver fin 12 on its top wall. The above oblique louver fin 12 is repeatedly and obliquely cut at an angle of attack "β" on its surface, thus having a plurality of oblique strips 12*a*. The strips 12*a* allow a main gas flow to collide thereon when the gas flow passes by the louver fin 12.

The above louver fin 12 is closely corrugated from the first to the last end with a short pitch.

The cutting angle "θ" of both ends of each flat tube 11 preferably ranges from 30° to 60°.

On the other hand, the collision angle "β" of the oblique strips 12*a* is preferably set to $0° \leqq \beta \leqq 80°$.

Figure 10:
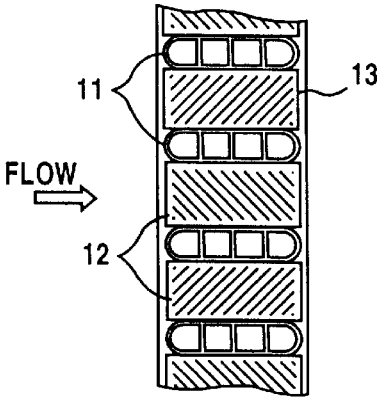
FIG. 10 is a sectional view showing four multi-channeled flat tubes of this invention provided with a plurality of oblique louver fins individually welded to the top and bottom walls of associated flat tubes.
Figure 10A:
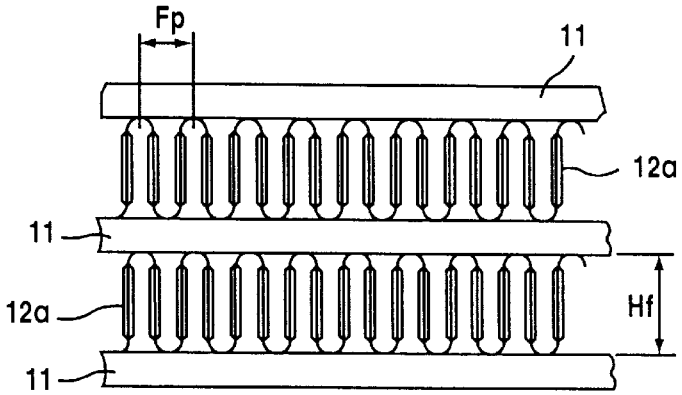
FIG. 10*a* is a front view showing three multi-channeled flat tubes of this invention with two oblique louver fins welded to the top and bottom walls of associated flat tubes.

FIG. 10 shows four multi-channeled flat tubes 11 of this invention provided with a plurality of oblique louver fins 12. As shown in the drawing, the louver fins 12 are individually welded to the top and bottom walls of associated flat tubes 11. This drawing shows that the oblique strips 12*a* of each louver fin 12 are inclined with respect to the main gas flow at the collision angle "β". FIG. 10*a* is a front view showing three multi-channeled flat tubes 11 with two oblique louver fins 12 welded to the top and bottom walls of associated flat tubes 11. This drawing shows that the oblique strips 12*a* are regularly formed on the side surfaces of each closely corrugated louver fin 12. In this drawing, the pitch of each closely corrugated louver fin 12 is designated by the character "Fp", while the height of the corrugated louver fin 12 is designated by the character "Hf".

Figure 11:
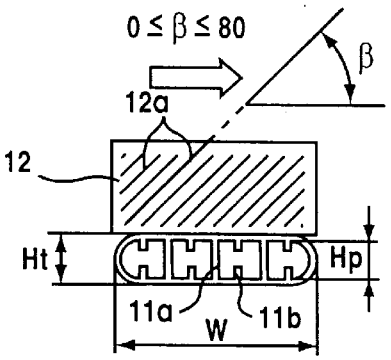
FIG. 11 is a sectional view showing a multi-channeled flat tube of this invention provided with one oblique louver fin welded to the top wall of said flat tube.
Figure 11A:
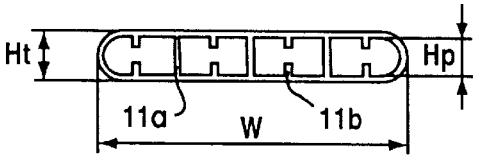
FIG. 11*a* is a sectional view showing the multi-channeled structure of each flat tube according to this invention.

As best seen in FIG. 11, each oblique louver fin 12 is welded to the top wall of a multi-channeled flat tube 11 of this invention. In addition, this drawing shows that it is preferable to set the angle of attack "β" of the oblique strips 12*a* to $0° \leqq \beta \leqq 80°$. FIG. 11*a* is a sectional view showing the multi-channeled structure of each flat tube 11. As shown in FIGS. 11 and 11*a,* the interior of each flat tube 11 is sectioned into a plurality of, for example, four isolated channels by a plurality of, for example, three section walls 11*a*. Each of the isolated channels is also partitioned into two or more communicating parts by top and bottom partition walls 11*b*. In FIGS. 11 and 11*a,* the thickness of the flat tube 11 is designated by the character "Ht", while the height of each channel defined in the flat tube 11 is designated by the character "Hp". In addition, the width of the flat tube 11 is designated by the character "W".

Figure 11B:
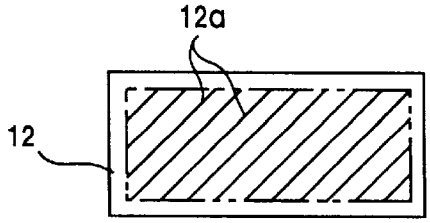
FIG. 11*b* is a view showing the profile of oblique strips formed on each louver fin in accordance with the primary embodiment of this invention.

FIG. 11*b* shows the profile of oblique strips formed on the louver fin 12 in accordance with the primary embodiment of this invention. In this embodiment, each of the oblique strips is formed as a straight strip 12*a* having an angle of attack "β".

Figure 11C:
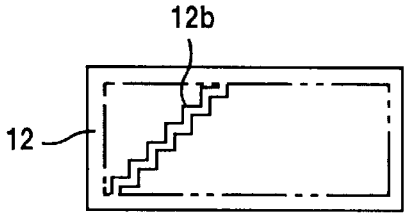
FIG. 11*c* is a view showing the profile of oblique strips formed on each louver fin in accordance with a first modification of the primary embodiment.

FIG. 11*c* shows the profile of oblique strips formed on the louver fin 12 in accordance with a first modification of the primary embodiment. In this modification, each of the oblique strips is formed as a stepped strip 12*b* having an angle of attack "β".

Figure 11D:
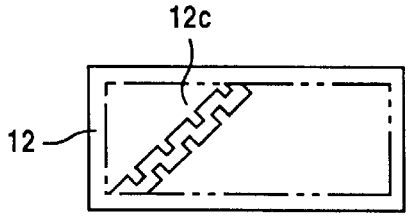
FIG. 11*d* is a view showing the profile of oblique strips formed on each louver fin in accordance with a second modification of the primary embodiment.
Figure 11E:
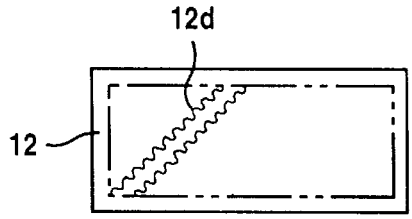
FIG. 11*e* is a view showing the profile of oblique strips formed on each louver fin in accordance with a third modification of the primary embodiment.

FIG. 11*d* shows the profile of oblique strips formed on the louver fin 12 in accordance with a second modification of the primary embodiment. In this modification, each of the oblique strips is formed as a toothed strip 12*c* having an angle of attack "β", FIG. 11*e* shows the profile of oblique strips formed on the louver fin 12 in accordance with a third modification of the primary embodiment. In this modification, each of the oblique strips is formed as a wavelet strip 12*d* having an angle of attack "β".

Figure 11F:
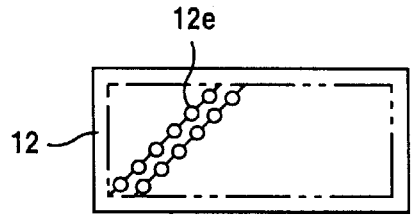
FIG. 11*f* is a view showing the profile of oblique strips formed on each louver fin in accordance with a fourth modification of the primary embodiment.

FIG. 11*f* shows the profile of oblique strips formed on the louver fin 12 in accordance with a fourth modification of the primary embodiment. In this modification, each of the oblique strips is formed as a straight strip 12*a,* which has an angle of attack "β" and a plurality of circle, ellipsoid, square, rhombus or similar holes 12*e* regularly formed along the strip 12*a*.

Figure 11G:
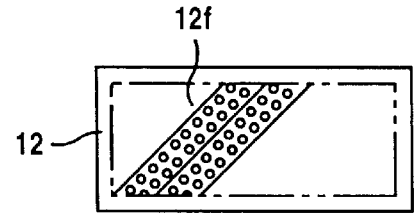
FIG. 11*g* is a view showing the profile of oblique strips formed on each louver fin in accordance with a fifth modification of the primary embodiment.

FIG. 11*g* shows the profile of oblique strips formed on the louver fin 12 in accordance with a fourth modification of the primary embodiment. In this modification, each of the oblique strips is formed as a straight strip 12*a,* which has an angle of attack "β" and a plurality of dents or dimples 12*f* regularly formed on the strip 12*a*.

In accordance with the first to fourth modifications of the primary embodiment, the uniquely designed oblique strips more preferably form vortexes in the gas flow due to a so-called "discrete effect", thus more violently mixing the gas flow and further improving the heat transferring effect of each oblique louver fin 12 in comparison with the straight strips 12*a*.

Figure 12A:
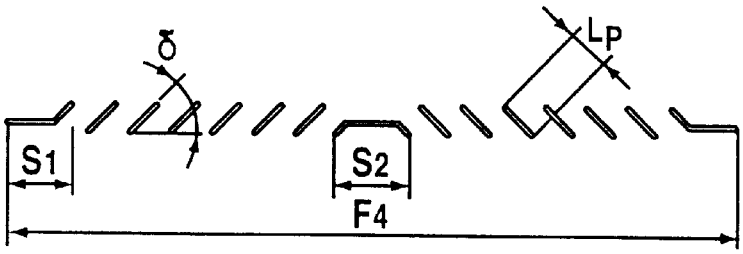
FIG. 12*a* is a sectional view of a louver fin provided with oblique strips in accordance with an embodiment of this invention.
Figure 12B:
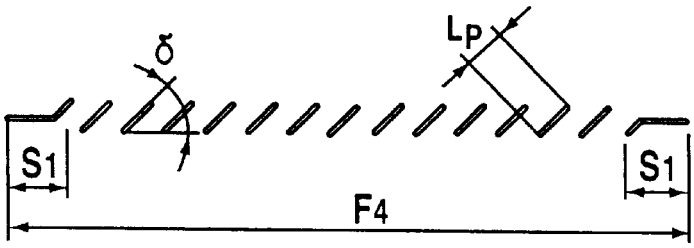
FIG. 12*b* is a sectional view of a louver fin provided with oblique strips in accordance with another embodiment of this invention.

FIGS. 12*a* and 12*b* are sectional views of louver fins provided with oblique strips in accordance with different embodiments of this invention, respectively. As shown in the drawings, it is possible to appropriately change the intervals between the strips and selectively change the direction of the strips, so that both the number of the strips formed on each louver fin and the opening direction of said strips are easily controlled when necessary. This allows the oblique louver fins of this invention to be more easily and simply manufactured. In the drawings, the width of the oblique louver fin is designated by the character "$F_4$", the width of the margin, defined at each side edge of the fin's side surface having the strips, is designated by the character "$S_1$", the width of each oblique strip is designated by the character "$L_p$", and the Louver angle of each oblique strip relative to the fin's side surface is designated by the character "δ". In addition, the character "$S_2$" in FIG. 12*a* designates the width of a central rib formed on the fin's side surface when two sets of oblique strips are formed on said fin's side surface in a way such that the two sets of strips are opened in opposite directions with the central rib extending at the intermediate position between the two sets of strips.

Figure 13:
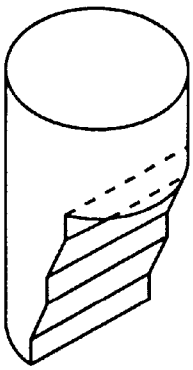
FIG. 13 is a perspective view of a jig selectively used for securing a precise fitting of the flat tube's oblique ends relative to the header pipes when the flat tubes of a module are fitted into two opposite header pipes of said module to different depths in accordance with this invention.

FIG. 13 is a perspective view of a jig, which is selectively used for securing a precise fitting of the flat tube's oblique ends relative to the header pipes when the flat tubes of a module are fitted into two opposite header pipes of said module to different depths in accordance with this invention. The above jig allows a worker to precisely and easily measure the different fitting depths of the oblique ends of the multi-channeled flat tubes 11 into two opposite header pipes 13, 131, 132, 133 of each module. The oblique ends, fitted into the header pipes of a module to such different depths, appropriately control the flow resistance within the header pipes. This allows the header pipes to uniformly distribute fluid for the flat tubes of the module.

In the OLF heat exchanger of this invention, a plurality of multi-channeled flat tubes are assembled with two opposite header pipes, thus forming a module having a predetermined heat exchanging capacity. The heat exchanger of this invention is thus formed by assembling a selected number of modules into a single body using a plurality of sockets and two support frames. It is thus possible to easily manufacture an OLF heat exchanger having a desired size and heat exchanging capacity.

In addition, the present invention provides a jig, which is selectively used for easily and precisely checking the different fitting depths of the multi-channeled flat tube's oblique ends of a module into two opposite header pipes of said module. The oblique ends, fitted into the header pipes to such different depths, appropriately control the flow resistance within the header pipes. This allows the header pipes to uniformly distribute fluid for the flat tubes of the module.

Since each of the multi-channeled flat tubes is obliquely cut at a cutting angle "θ", ranging from 30° to 60°, at both ends thereof. Due to the oblique configuration of the flat tube's ends, the total pressure of the fluid, liquid or gaseous refrigerant refrigerant at the inlet ends of said flat tubes is preferably increased, thus allowing the liquid refrigerant to be more smoothly introduced into the flat tubes through the inlet ends. Such an oblique configuration of the flat tube's ends also allow the liquid refrigerant to be more smoothly discharged from the flat tubes through the outlet ends of said flat tubes.

In the present invention, it is possible to somewhat freely change the cross-sectional area of both the section and partition walls, formed in the multi-channel of each flat tube, in accordance with a desired liquid pressure of said channel. Therefore, the channel of the flat tube can be freely designed to meet various fluids used as the working liquid of the OLF heat exchanger.

Different from typical louver fins with strips having an angle of attack of 90° with respect to the gas flow, the strips of the louver fins of this invention are designed to be oblique with an angle of attack "β" ($0° \leqq \beta \leqq 80°$).

Such oblique strips of the louver fin preferably form transverse and longitudinal vortexes in the gas flow around the louver fin, thus more violently mixing the gas flow and further improving the heat transferring effect of the louver fin. The oblique strips also force the gas flow to collide on the flat tubes, thus improving the heat transferring effect of the flat tubes.

In the invention, each oblique louver fin is closely corrugated from the first to the last end with a short pitch. Therefore, the louver fins of this invention preferably form a swirl in the gas flow around the fins, thus providing a three-dimensional cutoff effect on the path line of the gas flow in comparison with typical offset strip fins (OSF) merely providing a one-dimensional offset effect. Such an oblique louver fin also lengthens the path length of the gas flow around the fin. In addition, the flow length of the gas flow around the louver fin may be controlled by changing the collision angle "β" of the oblique strips of said louver fin, so that the louver fin of this invention more effectively and periodically breaks the boundary layer of the gas flow, which is grown as the gas passes by the strips of the louver fin, in comparison with typical louver fins. That is, the oblique strips of the louver fin primarily reduce the thickness of the boundary layer and finally remove said boundary layer within the vortex area defined between next strips, thus improving the heat transferring effect of the louver fin.

In a brief description, the oblique louver fins of this invention are designed to selectively have the advantages expected from typical louver fins and typical offset strip fins, and to have better flow mixing by the swirl motion due to the angle of attack.

As described above, the present invention provides a high efficiency modular OLF heat exchanger with heat transfer enhancement. In the heat exchanger of this invention, a plurality of multi-channeled flat tubes are assembled with two opposite header pipes, thus forming a module. Therefore, the heat exchanger of this invention is manufactured while easily changing its size and heat exchanging capacity by assembling a selected number of modules into a single body using a plurality of sockets and two support frames. The heat exchanger comprises oblique louver fins. The oblique louver fins are designed to form active vortexes in the gas flow and provide desired offset effect and desired scouring effect, thus improving the operational efficiency of the heat exchanger.

The heat exchanger of this invention may be preferably used as a condenser, evaporator, and radiator for automobiles or military tanks, or a condenser or an evaporator for air conditioners. In addition, the oblique louver fins of this invention may be preferably used as a means for forming a turbulent flow in an engine oil cooler for automobiles. The oblique louver fins of this invention effectively improve the operational efficiency and reduce the size and weight of a heat exchanger, thus improving the productivity in a process of manufacturing the heat exchangers.

On the other hand, it is possible to appropriately change the pitch of each corrugated louver fin and the intervals between the oblique strips, so that the louver fins are easily and simply manufactured while selectively changing said pitch and intervals when necessary.

In the present invention, each of the oblique strips of the louver fin may be formed as a straight strip, a stepped strip, a toothed strip, a wavelet strip, or a straight strip having regularly spaced holes. In the case of the stepped strips, the toothed strips, the wavelet strips, or the straight strips having regularly spaced holes, the oblique strips more preferably form vortexes in the gas flow due to a scouring effect caused by discreteness, thus more violently mixing the gas flow and further improving the heat transferring effect of the oblique louver fins in comparison with straight oblique strips.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A high efficiency modular OLF (oblique louver fin) heat exchanger with heat transfer enhancement, comprising:

two length adjustable side pipes vertically positioned at both sides of the heat exchanger, either of said two side pipes having inlet and outlet tubes at both ends thereof, said two side pipes individually comprising:

a plurality of header pipes having predetermined different lengths and selectively assembled with each other into a side pipe in order to accomplish a desired size and heat exchanging capacity of the heat exchanger, each of said header pipes having a plurality of fitting slits regularly arranged in an axial direction; and a plurality of header pipe sockets individually having an open ring or a blocking disk and linearly coupling said header pipes into a side pipe with the sockets having rings and the sockets having disks being alternately arranged on the side pipe, said sockets thus alternately opening and closing the side pipe so as to change a fluid path of the heat exchanger;

a plurality of multi-channeled flat tubes fitted into the fitting slits of two opposite header pipes at both ends thereof, thus extending horizontally between the two header pipes while being regularly spaced, each of said flat tubes being obliquely cut at a cutting angle "θ" at both ends thereof and having an oblique louver fin on a top wall thereof, said louver fin being repeatedly and obliquely cut at an angle of attack "β" on its surface, thus having a plurality of oblique strips, said strips allowing a main gas flow to collide thereon when the gas flow passes by the louver fin; and top and bottom support frames horizontally extending at top and bottom ends of the heat exchanger while being held by the two side pipes using a plurality of end caps, thus supporting the flat tubes while blocking both ends of a side pipe free from any inlet or outlet tube, whereby the flat tubes, assembled with the two opposite header pipes, form a module having a predetermined heat exchanging capacity, so that the heat exchanger is formed by assembling a selected number of modules into a single body using sockets and the support frames, thus having a desired heat exchanging capacity.

2. The OLF heat exchanger according to claim 1, wherein said an angle of attack "β" of each oblique strip is set to $0° \leqq \beta \leqq 80°$.

3. The OLF heat exchanger according to claim 1, wherein said cutting angle "θ" of each flat tube is set to $30° \leqq \theta \leqq 60°$.

4. The OLF heat exchanger according to claim 1, wherein the interior of each flat tube is sectioned into a plurality of isolated channels by a plurality of section walls and each of the isolated channels is partitioned into two or more communicating parts by top and bottom partition walls, with a total cross-sectional area of both the section and partition walls being changeable in accordance with a desired liquid pressure of each flat tube.

5. The OLF heat exchanger according to claim 1, wherein the oblique louver fin is corrugated with a pitch of the fin being changeable, thus selectively controlling its offset effect for the gas flow and periodically breaking a boundary layer of said gas flow, and finally removing said boundary layer within a vortex area defined between adjacent oblique strips.

6. The OLF heat exchanger according to claim 1, wherein a jig is selectively used for allowing the oblique ends of the multi-channeled flat tubes of each module to be precisely fitted into two opposite header pipes of said module to different depths, thus allowing said oblique ends to appropriately control the flow resistance within the header pipes and allowing the header pipes to uniformly distribute fluid for the flat tubes of said module.

7. The OLF heat exchanger according to claim 1, wherein each of said oblique strips is formed as a straight strip having the angle of attack "β".

8. The OLF heat exchanger according to claim 1, wherein each of said oblique strips is formed as a stepped strip having the angle of attack "β", said stepped strip being suitable for providing a discrete effect.

9. The OLF heat exchanger according to claim 1, wherein each of said oblique strips is formed as a toothed strip having the angle of attack "β", said toothed strip being suitable for providing a discrete effect.

10. The OLF heat exchanger according to claim 1, wherein each of said oblique strips is formed as a wavelet strip having the angle of attack "β", said wavelet strip being suitable for providing a discrete effect.

11. The OLF heat exchanger according to claim 7, wherein each of said oblique strips is formed as a straight strip having the angle of attack "β" and a plurality of holes formed along the straight strip, said straight strip, having the holes, being suitable for providing a discrete effect.

12. The OLF heat exchanger according to claim 7, wherein each of said oblique strips is formed as a straight strip having the angle of attack "β" and a plurality of dents or dimples formed along the straight strip, said straight strip, having the holes, being suitable for providing a discrete effect.

* * * * *